US010124209B2

(12) United States Patent
Park et al.

(10) Patent No.: US 10,124,209 B2
(45) Date of Patent: Nov. 13, 2018

(54) WALKING TRAINING APPARATUS

(71) Applicant: P&S MECHANICS CO., LTD., Seoul (KR)

(72) Inventors: Kwang Hun Park, Seoul (KR); Dong Chan Lee, Seongnam-Si (KR); Ki Hong Lee, Bucheon-Si (KR); Kyung Hwan Lee, Anyang-Si (KR)

(73) Assignee: P&S MECHANICS CO., LTD. (KR)

( * ) Notice: Subject to any disclaimer, the term of this patent is extended or adjusted under 35 U.S.C. 154(b) by 1136 days.

(21) Appl. No.: 14/376,842

(22) PCT Filed: Feb. 1, 2013

(86) PCT No.: PCT/KR2013/000845

§ 371 (c)(1),
(2) Date: Aug. 5, 2014

(87) PCT Pub. No.: WO2013/119001

PCT Pub. Date: Aug. 15, 2013

(65) Prior Publication Data

US 2014/0378279 A1 Dec. 25, 2014

(30) Foreign Application Priority Data

Feb. 8, 2012 (KR) ..... 10-2012-0012748

(51) Int. Cl.
*A61H 1/02* (2006.01)
*A63B 23/04* (2006.01)
(Continued)

(52) U.S. Cl.
CPC ..... *A63B 23/0405* (2013.01); *A61H 1/024* (2013.01); *A61H 1/0244* (2013.01);
(Continued)

(58) Field of Classification Search
CPC ..... A61H 1/00; A61H 1/02; A61H 1/0237; A61H 1/024; A61H 1/0249; A61H 1/0262;
(Continued)

(56) References Cited

U.S. PATENT DOCUMENTS 3,485,213 A * 12/1969 Scanlon ..... A01K 15/027 119/676
6,689,075 B2 2/2004 West
(Continued)

FOREIGN PATENT DOCUMENTS

KR 20090104261 A 10/2009
KR 20100106527 A 10/2010
(Continued)

OTHER PUBLICATIONS

International Search Report and Written Opinion for PCT/KR2013/000845, dated May 13, 2013.

*Primary Examiner* — Michael Tsai
(74) *Attorney, Agent, or Firm* — Renaissance IP Law Group LLP

(57) ABSTRACT

The present invention relates to a walking training apparatus. The walking training apparatus includes: a treadmill providing a bottom surface to allow a user who is training to walk to do so in a stationary position; a user counterweight unit including a counterweight, a wire, and a harness jacket, wherein the user counterweight unit lifts the user's body upward in order to reduce the load from the user's weight; a joint motion robot worn on one lower leg of the walker, wherein the joint motion robot is constituted by a hip-joint motion part, a knee-joint motion part, and an ankle-joint motion part; a joint motion robot support part supporting and coupled to the joint motion robot to reduce the load of the weight of the joint motion robot, wherein the joint motion robot support includes a horizontal movable part and a
(Continued)

vertical movable part for moving the joint motion robot; and a control unit linked with at least one of the treadmill, the user counterweight unit, the joint motion robot, and the joint motion robot support in order to generate a customized control signal according to the user and to transmit the signal.

11 Claims, 5 Drawing Sheets

(51) Int. Cl.

| | |
|---|---|
| ***A63B 22/02*** | (2006.01) |
| ***A63B 21/00*** | (2006.01) |
| ***A61H 3/00*** | (2006.01) |
| ***A63B 21/062*** | (2006.01) |
| *A63B 24/00* | (2006.01) |

(52) U.S. Cl.
CPC ..... *A61H 1/0262* (2013.01); *A61H 1/0266* (2013.01); *A61H 3/008* (2013.01); *A63B 21/00181* (2013.01); *A63B 21/0628* (2015.10); *A63B 21/154* (2013.01); *A63B 22/02* (2013.01); *A63B 22/0235* (2013.01); *A63B 23/04* (2013.01); *A61H 2201/1652* (2013.01); *A61H 2201/1676* (2013.01); *A61H 2201/5069* (2013.01); *A61H 2201/5079* (2013.01); *A61H 2203/0406* (2013.01); *A61H 2203/0487* (2013.01); *A63B 2024/0093* (2013.01)

(58) Field of Classification Search
CPC ..... A61H 1/0266; A61H 2201/12; A61H 2201/1207; A61H 2201/1215; A61H 2201/123
See application file for complete search history.

(56) References Cited

U.S. PATENT DOCUMENTS

| | | | | |
|---|---|---|---|---|
| 6,821,233 | B1 * | 11/2004 | Colombo | A61F 5/0102 482/54 |
| 8,152,699 | B1 * | 4/2012 | Ma | A61H 1/0229 482/54 |
| 2002/0026130 | A1 * | 2/2002 | West | A61F 5/0102 601/23 |
| 2004/0019304 | A1 * | 1/2004 | West | A61H 1/0237 601/5 |
| 2005/0101448 | A1 * | 5/2005 | He | A61H 1/0237 482/54 |
| 2010/0285929 | A1 | 11/2010 | Bayerlein et al. | |
| 2011/0009788 | A1 * | 1/2011 | Kelly | A61F 5/0102 602/16 |
| 2011/0294624 | A1 * | 12/2011 | Burnfield | A61H 1/0214 482/7 |
| 2012/0004581 | A1 * | 1/2012 | Dinon | A61H 1/0237 601/23 |
| 2014/0058299 | A1 * | 2/2014 | Sankai | A61B 5/112 601/35 |
| 2014/0094345 | A1 * | 4/2014 | Kim | A63B 21/4009 482/7 |
| 2014/0213951 | A1 * | 7/2014 | Pietrusisnki | A61H 1/024 602/23 |

FOREIGN PATENT DOCUMENTS

| | | | |
|---|---|---|---|
| WO | 200028927 | A1 | 5/2000 |
| WO | 2008124025 | A1 | 10/2008 |

* cited by examiner

WALKING TRAINING APPARATUS

TECHNICAL FIELD

The present disclosure relates to a walking training apparatus, and more particularly, to a walking training apparatus capable of eliminating a weight load of a joint motion robot and including a horizontal movable unit and a vertical movable unit to transfer the joint motion robot, in order to support and control the joint motion robot according to a state of a walking trainee or purposes of rehabilitation therapy and the like.

BACKGROUND ART

In general, a walking assist device is an instrument to assist walking of a walking trainee with walking handicap, the walking assist device which is used to help training or daily life of the walking trainee who wears it and be installed on a treadmill for the walking trainee to perform repeat walking for rehabilitation training for a walking trainee.

In the latter case, since the walking trainee performs rehabilitation training on the treadmill, a walking assist device supporting unit is necessary to install and support the walking assist device on the treadmill A typical walking assist device supporting device suggested on the U.S. Registered Pat. No. 6,821,233 is to stabilize the walking assist device and prevent inclination in the antero-posterior and medio-lateral directions, and its shape is a parallelogram, including a lower frame which is frame shaped, a coupling unit for the walking assist device, and two carriers connecting the lower frame and the coupling unit of the walking assist device.

In the typical walking assist device supporting device, since the lower frame and the walking assist device coupling unit are coupled in a shape of a parallelogram link, the walking assist device may move up-and-down according to rehabilitation training of a walking trainee.

Meanwhile, when a walking trainee performs rehabilitation training using the walking assist device, a balance weight is installed on the treadmill coupled to a breast belt and hip belt of the walking assist device worn on the walking trainee, so as to prevent shifting weights of the walking trainee and the walking assist device to the patient. A weight of the balance weight supports own weights of the walking trainee and the walking assist device, which prevents shifting the own weight of the walking assist device to the walking trainee.

However, in the typical walking assist device supporting device, since the own weights of the walking trainee and the walking assist device is simply supported by weights of the balance weight and the treadmill belt worn on the walking trainee and, after all, the treadmill belt is directly connected to the walking trainee, the own weights of the patient and the walking assist device is shifted to the walking trainee through the treadmill belt when the walking assist device moves up-and down by the walking trainee during rehabilitation training.

In addition, a body of the walking trainee moves up-and-down in accordance with a walking of the walking trainee during rehabilitation training but, in the typical supporting device for the walking assist device, a distance between the frame and the walking trainee of is determined by a parallelogram structure and the walking assist device moves back and forth in accordance with a height change, and thus the walking trainee is not securely supported and feels uncomfortable during rehabilitation training.

DISCLOSURE OF THE INVENTION

Technical Problem

The present disclosure provides a walking training apparatus which prevents shifting an own weight of a joint motion robot to a walking trainee and securely supports the walking trainee to feel comfortable during rehabilitation training.

Technical Solution

In accordance with an exemplary embodiment, an walking training apparatus includes: a treadmill providing a tread plate for a walking trainee to continue to perform walking training at a regular position; a counterload unit for a walking trainee including a counterload balance weight, a wire, and a harness jacket and lifting a body of the walking trainee upward to reduce a weight load of the walking trainee; a joint motion robot configured to be worn on a lower extremity of the walking trainee and including a hip joint training unit, a knee joint training unit, and an ankle joint training unit; a joint motion robot supporting unit including a horizontal movable unit and a vertical movable unit which adjust a position of the joint motion robot, wherein the joint motion robot supporting unit is coupled to the joint motion robot to eliminate a weight load of the joint motion robot; and a control unit configured to generate and transfer a control signal customized for the walking trainee, by being associated with at least one selected from the treadmill, the counterload unit, the joint motion robot, and the joint motion robot supporting unit.

The horizontal movable unit may include a horizontal linear motion rail, a horizontal linear motion block, and a horizontal movable part coupled to the horizontal liner motion block and moving horizontally according to a horizontal moving mechanism, and a first coupling supporting plate coupled to the horizontal movable part to move together with the horizontal movable part.

The vertical movable unit may be coupled to the first coupling supporting plate and include a vertical linear motion rail, a vertical linear motion block, a vertical movable part moving vertically according to a vertical moving mechanism, a vertical free movable part coupled to the vertical linear motion block and moving in according to a movement of the joint motion robot, and a second coupling supporting plate coupled to the vertical free movable part to move together with the vertical free movable part.

The vertical movable unit may be disposed between the vertical movable part and the vertical linear motion block and further include an inertia reducing unit configured to reduce an inertia varied with an operation of the joint motion robot The vertical movable unit may further include a pair of coupling unit coupled to the joint motion robot and a gap adjusting unit adjusting a gap between the pair of coupling unit in accordance with a pelvic size of the walking trainee, wherein the coupling unit and the gap adjusting unit may be coupled and supported by the second coupling supporting plate.

The joint motion robot supporting unit may further include a counterload unit of the joint motion robot to counterbalance a weight load of the joint motion robot.

At least one selected from the horizontal movable unit, the vertical movable unit, and the gap adjusting unit may be automatically controlled by receiving a control signal customized for the walking trainee.

The joint motion robot may further include length adjusting units which are adjustable according to lengths of walking trainee's legs between the hip joint moving unit and the knee joint moving unit or between the knee joint moving unit and the ankle joint moving unit.

An actuator driving each of joints may be provided on a hip joint moving unit, a knee joint moving unit, and an ankle joint moving unit, and the actuator is configured by a motor, a pulley.

In addition, the ankle joint moving unit may include an ankle joint elastic device, an adduction/abduction guide enabling a rotation, and an adduction/abduction fixing clamp configured to fix a rotational angle.

The walking training apparatus may further include a slant plate bridging between an upper portion of the treadmill and a ground surface and comprising a pair of height adjusting units adjusting the left/right heights of the slant plate respectively and a supporting frame configured to support the counterload unit for the walking trainee, the joint motion robot, and the joint motion robot supporting unit, wherein the supporting frame includes an upper supporting frame and an lower supporting frame which are detachably coupled by a hinge.

Advantageous Effects

A walking training apparatus in accordance with an exemplary embodiment includes a joint motion robot supporting unit supporting the joint motion robot and as well as eliminating a weight load of the joint motion robot to eliminate the load occurred by own weight of the joint motion robot, and thus the own weight of the joint motion robot is not shifted to the walking trainee during rehabilitation training, thereby minimizing fatigue of walking trainee during rehabilitation training and maximizing an efficiency of rehabilitation training.

In addition, a joint motion robot supporting unit of an exemplary embodiment includes a horizontal movable unit and a vertical movable unit which may adjust a position of the joint motion robot to be able precisely adjust a position of the joint motion robot supporting unit in accordance with a state of the walking trainee and a training purpose, thereby providing secure walking training for the walking trainee.

MODE FOR CARRYING OUT THE INVENTION

Hereinafter, detailed descriptions of specific embodiments described below provide various descriptions of the specific embodiments of the present invention.

The present invention may, however, be embodied in different forms and should not be construed as limited to the embodiments set forth herein. A detailed description is described with reference to the accompanying drawings in which the same reference number represents the same or functionally similar elements.

Figure 1:
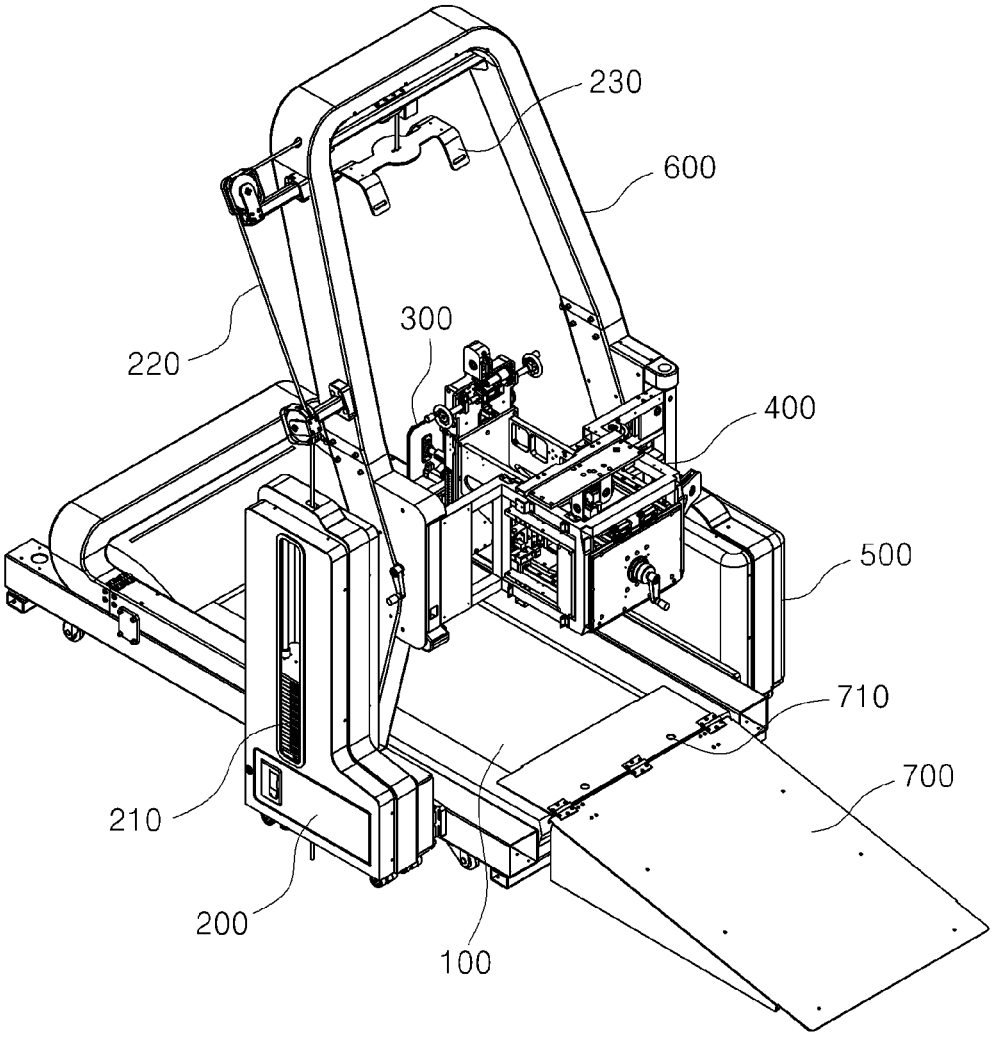
FIG. 1 is a perspective view illustrating a walking training apparatus in accordance with an exemplary embodiment.

FIG. 1 is a cross-sectional view illustrating a walking training apparatus in accordance with an exemplary embodiment, and the walking training apparatus in accordance with an exemplary embodiment includes a treadmill 100; a counterload unit 200 for a walking trainee; a joint motion robot 300; a joint motion robot supporting unit 400; a control unit (not shown); a supporting frame 600 supporting the treadmill 100, the counterload unit 200 for a walking trainee, the joint motion robot 300, the joint motion robot supporting unit 400 or the like; a slant plate 700; or the like.

The treadmill 100 provides a tread plate for a walking trainee to continue to train in a regular position. The treadmill 100 may be operated at walking speed synchronized with the joint motion robot in a range of 0.3 km/h to 3.0 km/h during operation of the walking training apparatus, and automatically controlled by the control unit in accordance with a state of the walking trainee and a training purpose. In addition, it may be operated manually in accordance with a will of the walking trainee. The treadmill 100 may move with wheels installed on a bottom thereof and stop to fix a position thereof by using a break.

The counterload unit 200 for the walking trainee includes a counterload balance weight 210, a wire 220, a harness jacket (not shown), and a coupling bar 230, wherein the harness jacket and the coupling bar 230 are able to be separated and, when the walking trainee wearing the harness jacket stands on the treadmill 100, the harness jacket and the coupling bar 230 are coupled to lift a body of the walking trainee upward so as to reduce a weight load of the walking trainee. The counterload balance weight 210 may be manually set to a counterload-weight (for example, 5 kg-unit) in consideration of the weight of the walking trainee, and a wire 220 passing through the counterload balance weight 210 is compressed by a rope compressing device so that the counterload-weight is loaded on the wire. The wire 220 connected to the counterload balance weight 210 moves in a pulley way through three rollers, so that the weight of the walking trainee and the weight of the counterload balance weight are counterbalanced.

The joint motion robot 300 is worn on a lower extremity of the walking trainee and includes a hip joint, a knee joint, and an ankle joint training unit. The joint motion robot supporting unit 400 is coupled to the joint motion robot 300 to eliminate a weight load of the joint motion robot 300 and configured to include a horizontal movable unit and a vertical movable unit which may adjust a position of the joint motion robot 300. The joint motion robot 300 and the joint motion robot supporting unit 400 will be described in detail later.

The control unit (not shown) generates and transfers a control signal suitable for the walking trainee, by being associated with at least one selected from the treadmill 100, the counterload unit 200, the joint motion robot 300, and the joint motion robot supporting unit 400. The control unit generates a control signal to control the walking training apparatus by using information entered from a walking trainee information system (not shown) included in the control unit, and the control unit may be configured to be attached on the treadmill 100 or as an additional apparatus. An administrator or the walking trainee may self-enter patient information in a walking trainee information system through a display unit, wherein the entered information includes a height, a weight, a length of a hip joint, a knee joint, and an ankle joint, a strength of a left/right leg, a flexion-extension value of a knee and an ankle and the like. The control unit may automatically adjust a length between each of the joints and operational range of each of the joints of the joint motion robot 300 by using walking trainee information entered through a patient information input system. A treadmill speed and a stride range in accordance with a state of the walking trainee and a training purpose are entered in the walking trainee information system, and the control unit operates the treadmill within the entered range. The control unit controls speeds of the joint motion robot 300 and the treadmill 100 to be synchronized and forcibly closes the system to stop the joint motion robot 300 and the treadmill 100 when the speeds of the joint motion robot 300 and the treadmill 100 are desynchronized or a walking pattern of the treadmill 100 is out of an entered information. In addition, the control unit also forcibly closes the system by receiving an overload signal through a sensor when a walking trainee applies an excessive force on the joint motion robot 300. Furthermore, a position of the joint motion robot supporting unit 400 may be automatically adjusted on the basis of walking trainee information. Walking training data of the walking trainee may be stored to accumulate on a database.

A slant plate 700 allows a walking trainee to easily ride on the walking training apparatus by bridging between an upper portion of the treadmill 100 and a ground surface. The slant plate includes a pair of height adjusting unit 710 having a screw thread which allows each of the left/right heights of the slant plate to be adjusted in accordance with a flatness difference and height difference between the treadmill 100 and the ground surface.

Figure 2:
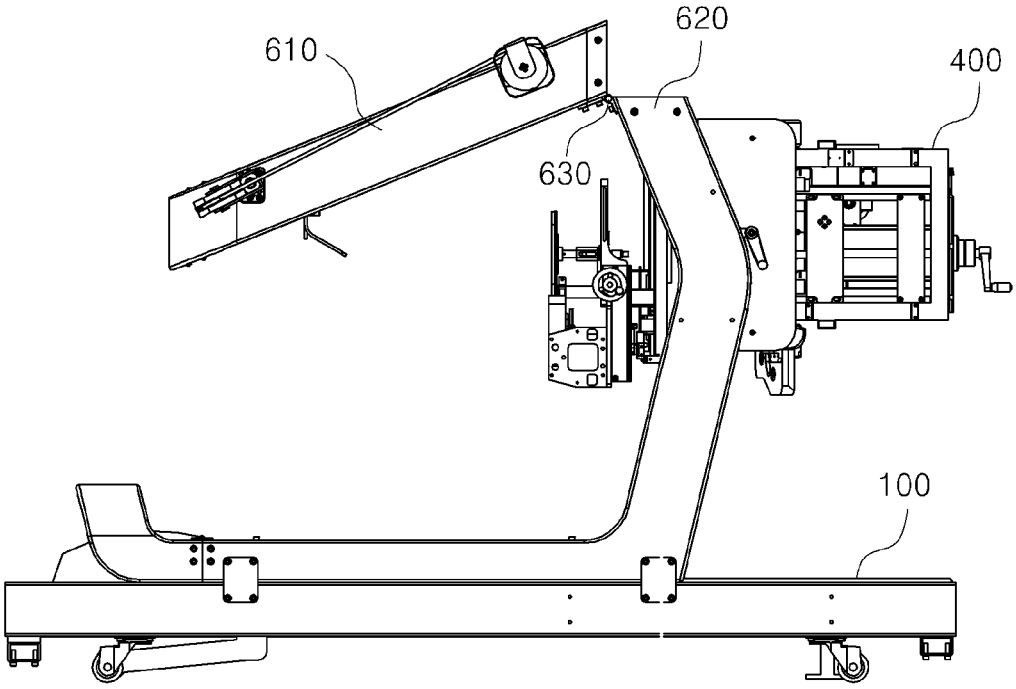
FIG. 2 is a side view illustrating a walking training apparatus in accordance with an exemplary embodiment.

FIG. 2 is a side view of the walking training apparatus illustrating the supporting frame 600 in detail in accordance with an exemplary embodiment. The supporting frame 600 supports the counterload unit 200 for the walking trainee, the joint motion robot 300, and the joint motion robot supporting unit 400 or the like and includes an upper supporting frame 610 and a lower supporting frame 620. When the walking training apparatus is installed to operate, the upper supporting frame 610 and the lower supporting frame 620 are coupled to support units of the walking training apparatus and when there is a height limitation for moving the walking training apparatus, for moving convenience, the upper supporting frame 610 and the lower supporting frame 620 are hinge jointed to be able to separate, and thus the supporting frame unit 600 may be folded to move as illustrated in FIG. 2.

Figure 3A:
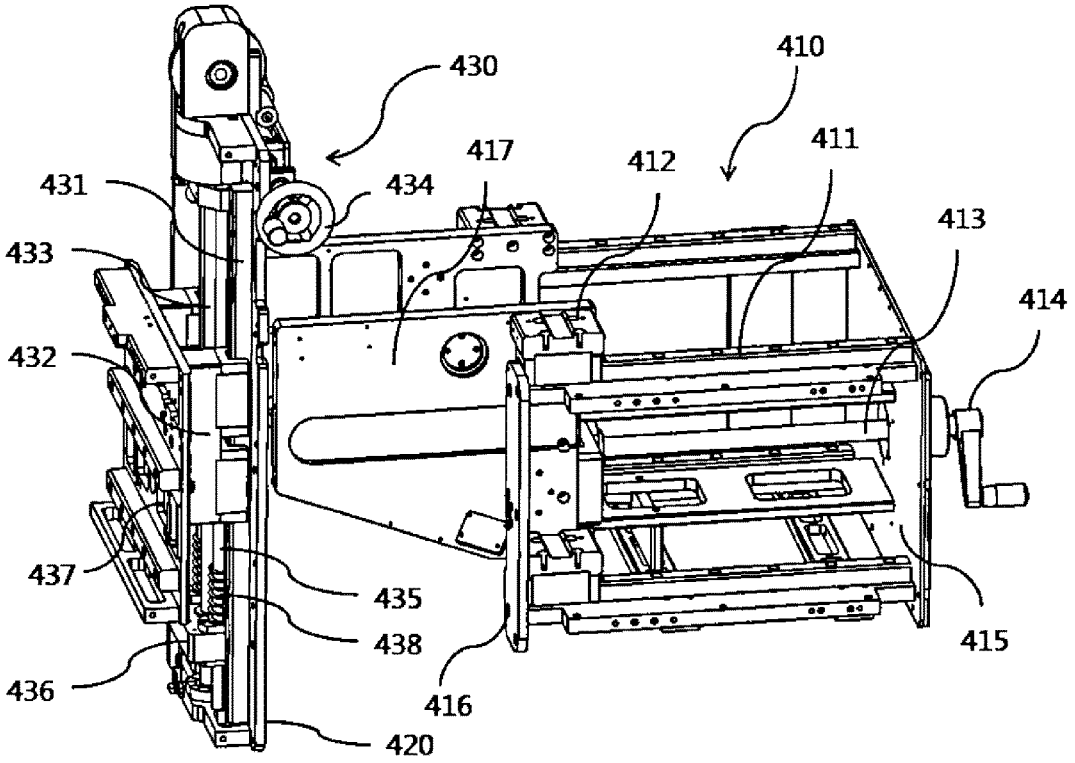
FIGS. 3*a* and 3*b* are perspective views illustrating a joint motion robot supporting unit as seen from a direction and another direction in accordance with an exemplary embodiment.
Figure 3B:
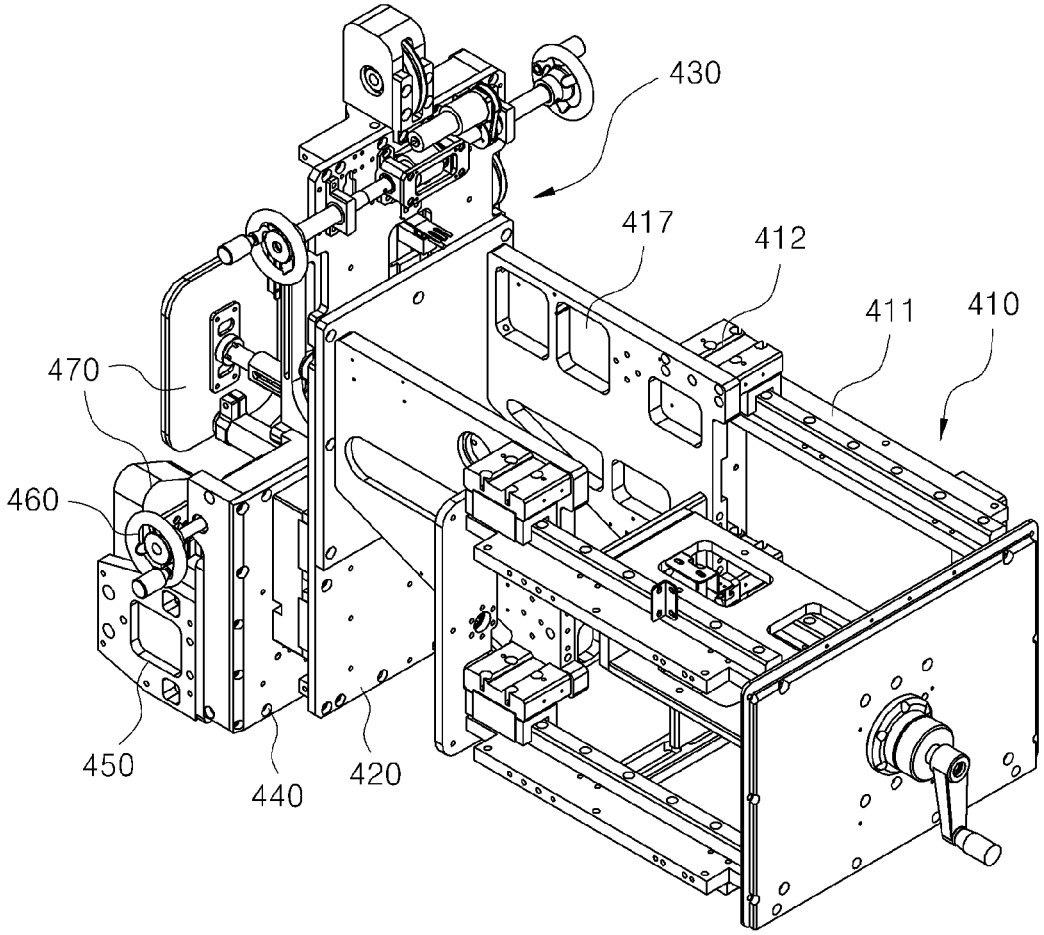

FIGS. 3*a* and 3*b* are perspective views illustrating the joint motion robot supporting unit 400 as seen from a direction and another direction in accordance with an exemplary embodiment. The joint motion robot supporting unit 400 connects the joint motion robot 300 with the supporting frame 600 to securely support the joint motion robot 300, eliminates to counterbalance a weight load of the joint motion robot 300, and includes the horizontal movable unit and the vertical movable unit to simultaneously adjust a position of the joint motion robot 300, so that the joint motion robot supporting unit moves to a rest position for the walking trainee to ride on the treadmill when the walking training apparatus is turned off and attaches the joint motion robot 300 on the walking trainee when the walking trainee rides on to turn on the walking training apparatus.

The joint motion robot supporting unit 400 is configured to include the horizontal movable unit 410, the vertical movable unit 420, the joint motion robot coupling unit 460 and the like.

The horizontal movable unit 410 allows the joint motion robot 300 to move back and forth, and includes a horizontal guide, wherein the horizontal guide is provided with a horizontal linear motion (LM) rail 411 disposed between first and second supporting plates 415 and 416 which determine a horizontal moving range, and a horizontal linear motion (LM) block 412 moving linearly along the horizontal linear motion (LM) rail 411. The horizontal movable unit 410 further includes a horizontal movable part 417 which is connected to the horizontal linear motion block 412 and moves horizontally in accordance with a horizontal moving mechanism. Referring to FIG. 3*a*, the horizontal moving mechanism is a mechanism allowing the horizontal movable part 417 to horizontally move by a gear and a rotational force of a rotational shaft 413. The horizontal moving mechanism may be manually operated by a rotation of a handle 414, but is not limited thereto, and thus be automatically operated by a rotation motor. In addition, the horizontal moving mechanism may also use a linear motor. A first coupling supporting plate 420 is coupled to an end portion of the horizontal movable part 417 to move together with the horizontal movable part. A second supporting plate 416 extends to be coupled to the supporting frame unit 600 to thereby support the joint motion robot 300 and the joint motion robot supporting unit 400.

The vertical movable unit 430 is coupled to the first coupling supporting plate 420 moving horizontally to adjust a height of the joint motion robot 300 by moving up-and-down in accordance with a height of the walking trainee, including a vertical movable unit 436 moving vertically in accordance with the vertical moving mechanism.

Referring to FIG. 3*a*, the vertical moving mechanism allows the vertical movable unit 436 to vertically move by a gear, a rotational force of a rotational shaft 433 or the like, which may be manually operated by a rotation of a handle 434, but is not limited thereto, and automatically operated by a rotation motor. In addition, the vertical movable unit 436 may be automatically operated by a linear motor. The vertical movable unit 436 adjusts a height of the joint motion robot 300.

The vertical movable unit 436 further includes a vertical guide including a vertical linear motion (LM) rail 431 and a vertical linear motion block 432 disposed on the vertical linear motion (LM) rail 431 to move up-and-down. The vertical linear (LM) motion block 432 is coupled to a vertical free movable part 437 which supports the joint motion robot 300 by freely moving up-and-down in accordance with a moving of the joint motion robot 300 occurred during walking training of the walking trainee. An initial height of the joint motion robot 300 is determined by using the vertical movable part 436 in accordance with a height of the walking trainee or a training purpose and the second coupling supporting plate 440 is coupled to a side of the vertical free movable part 437 to move up-and-down together with the vertical free movable part.

When the joint motion robot 300 moves downward according to the walking training of the walking trainee, a load of the joint motion robot 300 applies directly to the vertical movable part 436 because the vertical linear motion block 432 coupled to the vertical free movable part 437 is downward supported by the vertical movable part 436 which determines the height of the joint motion robot 300, which may cause a problem. Accordingly, an inertia reducing unit 438 which reduces an inertia varied with an operation of the joint motion robot 300 may be installed between the vertical movable part 436 moved by the vertical moving mechanism and the vertical linear motion (LM) block 432, thereby relieving a shock. The inertial reducing unit 438 may be one selected from a spring, a gas pressure spring, an elastic body, and a damper.

The joint motion robot supporting unit 400 may further include a pair of coupling unit 450 coupled to the joint motion robot 300 and a gap adjusting unit 460 adjusting a gap between the pair of coupling unit 450 according to a pelvic size of the walking trainee. The gap adjusting unit 460 may be operated manually and as well as operated automatically using a motor The coupling unit 450 and the gap adjusting unit 460 are coupled to be supported by the second coupling supporting plate 440 of the vertical movable unit 430. Two pads 470 are provided on the joint motion robot supporting unit 400 to adhere to a back and hip of the walking trainee so as to keep patient's balance.

The joint motion robot supporting unit 400 may further include a counterload unit 500 of the joint motion robot to counterbalance a weight load of the joint motion robot 300. The counterload unit 500 of the joint motion robot efficiently eliminates a load according to a weight of the joint motion robot by being fixed to couple to the second supporting plate 440 coupled with the joint motion robot 300 to support upward to apply counterload on the joint motion robot 300, so that the walking trainee may securely ride on the joint motion robot to perform walking training.

In the walking training apparatus in accordance with an exemplary embodiment, a weight of the walking trainee is supported by the counterload unit 200 of the walking trainee and a weight of the joint motion robot 300 is supported by using the joint motion robot supporting unit 400, which results that the walking trainee and the joint motion robot 300 are separately supported, so that it is fundamentally prevented that a limitation of shifting a weight of a walking assist device to the walking trainee by simultaneously supporting weights of the walking assist device and the walking trainee using a treadmill belt. Furthermore, the joint motion robot supporting unit 400 in accordance with an exemplary embodiment may precisely adjust a position of the joint motion robot up-and-down and forth-and-back to be able to adhere to the walking trainee according to a state of the walking trainee and a training purpose, and allow the walking trainee to feel comfortable even during walking training by positioning the walking trainee at a center position where a wire supporting the walking trainee upward comes downward.

The horizontal movable unit 410, the vertical movable unit 430, and the coupling unit 450 in accordance with an exemplary embodiment may be automatized by using a rotation or linear motor, and the control unit may automatically control a position of the joint motion robot supporting unit 400 by using a control signal generated in the basis of training information or walking trainee's body size such as a height entered into the walking trainee information system (not shown), and thus the joint motion robot may position at a regular position for each of the walking trainees to allow the walking trainee to further feel security.

Figure 4:
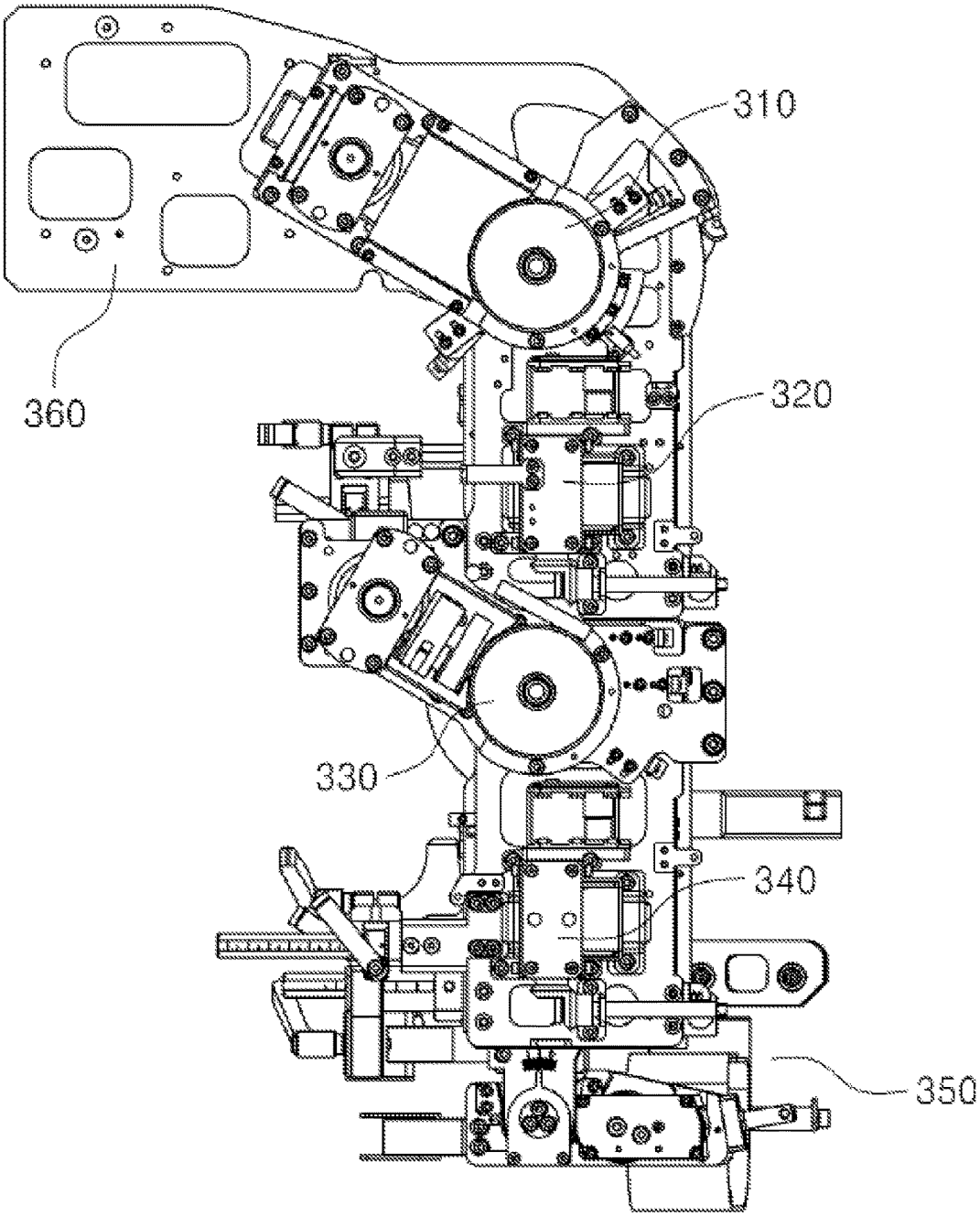
FIG. 4 is a cross sectional view illustrating a joint motion robot in accordance with an exemplary embodiment.

FIG. 4 is a side view illustrating the joint motion robot in accordance with an exemplary embodiment, wherein the joint motion robot 300 in accordance with an exemplary embodiment is worn on a lower extremity of the walking trainee, includes a hip joint moving unit 310, a knee joint moving unit 330, and an ankle joint moving unit 350, and is installed on both legs to drive for assisting a walking of the walking trainee with walking handicap. An actuator driving each of the joints is respectively provided on a hip joint moving unit 310, a knee joint moving unit 330, and an ankle joint moving unit 350, and the actuator includes a motor, a pulley, and a belt and controlled by the control unit. Each of the joint motion units prevents contact between the joint motion robot 300 and the walking trainee, covered by an outer cover for protecting an inner configuration.

The joint motion robot 300 may further include length adjusting units 320 and 340 which are able to be adjusted according to lengths of walking trainee's legs between the hip joint moving unit and the knee joint moving unit or between the knee joint moving unit and the ankle joint moving unit. Each of the lengths between joints may be automatically adjusted according to a body shape of the walking trainee and a manual adjusting handle may be installed for finely adjusting a segment length when an error has been occurred by automatic length adjustment.

In addition, a connecting coupling unit 360 of the joint motion robot 300 is connected to be coupled to the coupling unit 450 of the joint motion robot supporting unit 400 to support the joint motion robot 300.

The joint motion robot 300 may adjust a width and a height using an adjusting lever and a detachable pad is provided on a hip joint, a knee joint, and an ankle joint to fix a waist, a calf, and an ankle to a leg driving unit. Each of the pads may be adjusted adduction/abduction and back/forth and two types of medium/large-size may be provided according to a body shape of the patient. A position sensor is embedded in a bottom end portion of the hip joint to check and transmit an operating speed and driving angle of leg driving unit to the control unit.

The ankle joint moving unit 350 may further include an ankle joint elastic device to prevent leg dragging phenomenon by maintaining of an angle of an ankle joint in a range of dorsiflexion of 15° and plantarflexion of 10° from a time when a leg is detached from a surface to a time when a leg is attached to a surface by using a tension of a spring during walking. In addition, the ankle joint moving unit 350 includes an adduction/abduction guide capable of rotating and an adduction/abduction fixing clamp fixing a rotational position and may be rotated by the adduction/abduction guide at an appropriate angle, and thus even when the walking trainee has bow-legs and walks splay-footed, it is possible to make legs of the walking trainee in a comfortable and natural state. Therefore, a moving of the ankle joint of the walking trainee becomes natural and an efficiency of the rehabilitation training may be increased.

Although the walking training apparatus has been described with reference to the specific embodiments, it is not limited thereto. Therefore, it will be readily understood by those skilled in the art that various modifications and changes can be made thereto without departing from the spirit and scope of the present invention defined by the appended claims.

What is clamed is:

1. A walking training apparatus, comprising:

a treadmill providing a tread plate for a walking trainee to continue to perform walking training at a regular position;

a counterload unit for a walking trainee comprising a counterload balance weight, a wire, and a harness jacket, and lifting a body of the walking trainee upward to reduce a weight load of the walking trainee;

a joint motion robot configured to be worn on a lower extremity of the walking trainee and comprising a hip joint moving unit, a knee joint moving unit, and an ankle joint moving unit;

a joint motion robot supporting unit coupled to the joint motion robot to eliminate a weight load of the joint motion robot; and a control unit configured to generate and transfer a control signal customized for the walking trainee, by being associated with at least one selected from the treadmill, the counterload unit, the joint motion robot, and the joint motion robot supporting unit, wherein the joint motion robot supporting unit comprises a horizontal movable unit to move the joint motion robot back and forth; and a vertical movable unit coupled to the horizontal movable unit to move the joint motion robot up and down, wherein the horizontal movable unit and the vertical movable unit adjust a position of the joint motion robot, wherein the joint motion robot further comprises length adjusting units which are adjustable according to lengths of walking trainee's legs between the hip joint moving unit and the knee joint moving unit, or between the knee joint moving unit and the ankle joint moving unit, and wherein the ankle joint moving unit comprises an ankle joint elastic device, an adduction/abduction guide enabling a rotation, and an adduction/abduction fixing clamp configured to fix a rotational angle.

2. The apparatus of claim 1, wherein the horizontal movable unit comprises a horizontal linear motion rail, a horizontal linear motion block, a horizontal movable part coupled to the horizontal linear motion block and moving horizontally according to a horizontal moving mechanism, and a first coupling supporting plate coupled to the horizontal movable part to move together with the horizontal movable part.

3. The apparatus of claim 2, wherein the vertical movable unit is coupled to the first coupling supporting plate, and comprises a vertical linear motion rail, a vertical linear motion block, a vertical movable part moving vertically according to a vertical moving mechanism, a vertical free movable part coupled to the vertical linear motion block and moving according to movement of the joint motion robot, and a second coupling supporting plate coupled to the vertical free movable part to move together with the vertical free movable part.

4. The apparatus of claim 3, wherein the vertical movable unit further comprises an inertia reducing unit disposed between the vertical movable part and the vertical linear motion block to reduce an inertia varied with an operation of the joint motion robot.

5. The apparatus of claim 4, wherein the inertia reducing unit is one selected from a spring, a gas pressure spring, an elastic body, and a damper.

6. The apparatus of claim 3, further comprising:

a pair of coupling unit configured to couple to the joint motion robot; and a gap adjusting unit configured to adjust a gap between the pair of coupling unit according to a pelvic size of the walking trainee, wherein the coupling unit and the gap adjusting unit are coupled and supported by the second coupling supporting plate.

7. The apparatus of claim 6, wherein at least one selected from the horizontal movable unit, the vertical movable unit, and the gap adjusting unit is automatically controlled by receiving a control signal customized for the walking trainee.

8. The apparatus of claim 1, wherein the joint motion robot supporting unit further comprises the counterload unit for the joint motion robot configured to counterbalance a weight load of the joint motion robot.

9. The apparatus of claim 1, wherein actuators comprising a motor, a pulley, and a belt are respectively provided to drive each of the hip joint moving unit, the knee joint moving unit, and the ankle joint moving unit.

10. The apparatus of claim 1, wherein the apparatus further comprises a slant plate bridging between an upper portion of the treadmill and a ground surface and comprising a pair of height adjusting units adjusting a left height and a right height of the slant plate, respectively.

11. The apparatus of claim 1, further comprising a supporting frame configured to support the counterload unit for the walking trainee, the joint motion robot, and the joint motion robot supporting unit, wherein the supporting frame comprises an upper supporting frame and a lower supporting frame which are detachably coupled by a hinge.

* * * * *